US009925735B2

(12) United States Patent
Ludwig et al.

(10) Patent No.: US 9,925,735 B2
(45) Date of Patent: Mar. 27, 2018

(54) QUILLING TOOL

(71) Applicant: Pulsar Eco Products LLC, Cleveland, OH (US)

(72) Inventors: Eric Ludwig, Shaker Heights, OH (US); Mimillia May, Cleveland Heights, OH (US)

(73) Assignee: PULSAR ECO PRODUCTS LLC, Cleveland, OH (US)

( * ) Notice: Subject to any disclaimer, the term of this patent is extended or adjusted under 35 U.S.C. 154(b) by 303 days.

(21) Appl. No.: 14/809,952

(22) Filed: Jul. 27, 2015

(65) Prior Publication Data

US 2016/0023421 A1 Jan. 28, 2016

Related U.S. Application Data

(60) Provisional application No. 62/029,528, filed on Jul. 27, 2014.

(51) Int. Cl.

| | |
|---|---|
| ***B31C 99/00*** | (2009.01) |
| ***B65H 54/00*** | (2006.01) |
| ***B44C 5/00*** | (2006.01) |
| ***B65H 54/10*** | (2006.01) |
| ***B65H 54/44*** | (2006.01) |
| ***B65H 75/10*** | (2006.01) |
| ***B65H 75/30*** | (2006.01) |

(52) U.S. Cl.

CPC ..... *B31C 13/00* (2013.01); *B44C 5/00* (2013.01); *B65H 54/106* (2013.01); *B65H 54/44* (2013.01); *B65H 75/10* (2013.01); *B65H 75/30* (2013.01); *B65H 2701/37* (2013.01)

(58) Field of Classification Search

CPC ..... B31C 13/00; B65H 75/30; B65H 75/10; B65H 54/106; B65H 54/44; B65H 2701/37; B44C 5/00

See application file for complete search history.

(56) References Cited

U.S. PATENT DOCUMENTS

| | | | | |
|---|---|---|---|---|
| 2,168,465 | A * | 8/1939 | Amrhein | B65H 75/06 242/118.32 |
| 2011/0095126 | A1* | 4/2011 | Bartkowski | B31C 13/00 242/548.2 |
| 2011/0308696 | A1* | 12/2011 | Suskin | B31C 7/00 156/63 |

FOREIGN PATENT DOCUMENTS

WO WO 2016/151555 * 9/2016

* cited by examiner

*Primary Examiner* — William A. Rivera
(74) *Attorney, Agent, or Firm* — Medley, Behrens & Lewis, LLC

(57) ABSTRACT

A quilling tool includes a housing, a motor, a spindle, and a platform. The motor is positioned inside the housing and coupled to a power source. The spindle is coupled to the motor and extends from the housing. The motor is operable to rotate the spindle when powered by the power source. The spindle has a portion for receiving a separate strip of paper. The platform is positioned adjacent the spindle and the housing. The platform is removable from the body in order to remove a wound strip of paper. A method for quilling strips of material is also included.

18 Claims, 3 Drawing Sheets

QUILLING TOOL

CROSS-REFERENCE TO RELATED APPLICATION

This application claims priority to provisional application No. 62/029,528, filed on Jul. 27, 2014, the disclosure of which is incorporated herein by reference in its entirety.

FIELD

The invention concerns a quilling tool for use in quilling.

BACKGROUND

Quilling or paper filigree is an art form that involves the use of strips of paper that are rolled, shaped, and glued together to create decorative designs. Strips of paper are rolled, looped, curled and otherwise manipulated to create shapes using a hand held quilling tool. The shapes are then used to decorate greeting cards, pictures, and other articles. A quilling tool is a device that is typically a stick-like member that has a spindle with a slot at one end into which paper can be secured. The user spins the tool around its axis in order to wind the paper around the spindle. The paper can then be removed from the tool and used to make decorative designs. Quilling is often time consuming and tedious due to the manual nature of the spinning of the tool. It can also result in fatigue to a user's hands.

SUMMARY

A quilling tool is shown and described. A method of quilling is also shown and described.

DETAILED DESCRIPTION

Figure 2:
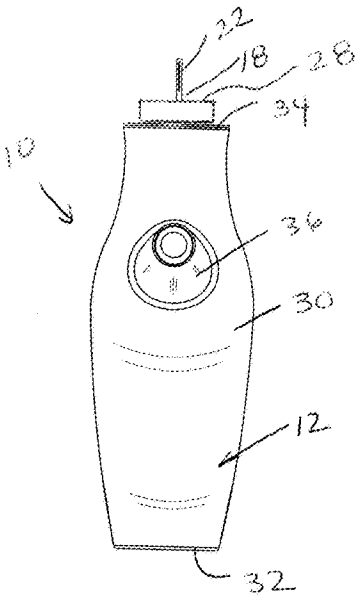
FIG. 2 depicts a side view of the example tool of FIG. 1 with a platform installed around the spindle.

The example quilling tool 10 is motorized in order to make the art of quilling faster to accomplish with less fatigue to the hand. The tool 10 is shown in the attached Figures and includes a housing 12 that stores a motor 14 and one or more batteries 16. The batteries 16 are used to power the motor 14 and the motor 14 is coupled to a shaft or spindle 18. A button or activation member 20 is positioned on an external surface of the housing 12 for activating the motor 14. The button 20 serves as a switch to turn the tool 10 on and off. When the button 20 is pushed, the tool 10 is turned on. When the button 20 is released, the tool 10 is turned off. The spindle 18 is coupled to the motor 14 and is configured to spin. The spindle 18 extends from one end of the housing 12. The spindle 18 has an attachment mechanism 22 for permitting a strip of material to be coupled to the spindle 18.

Figure 3:
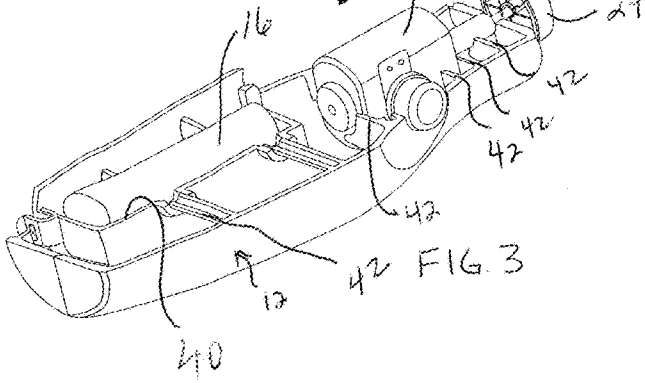
FIG. 3 depicts a perspective front view of an interior of the housing shown in FIGS. 1.

In the embodiments shown, the spindle 18 is has a slot 22 at one end in order to accept an end of a strip of quilling material, such as paper. Other means for attaching the paper to the spindle 18 may be utilized. Once the end of the quilling strip has been positioned in the slot 22 of the tool 10, the tool 10 is ready to be used. A removable platform 24 is shown in FIGS. 2 and 3 as being positioned around the spindle 18, with the spindle 18 extending axially through the platform 24. The platform 24 is round and disc-shaped, with a hole 26 in the center. An upper surface 28 of the platform 24 is flat and is the surface against which material is quilled. A platform 24 that is not flat may be useful in some instances. The hole 26 in the platform 24 is used to position the platform 24 on the spindle 18 so that the platform 24 slides onto and down the spindle 18 until the bottom surface of the platform 24 abuts a surface of the housing 12. As shown best in FIG. 7, after the user spins the strip of material into a roll, the user can remove both the paper and the platform 24 from the tool in order to avoid unwinding the spool of paper during removal. The platform 24 helps to maintain the strip of paper in a wound state. The platform 24 is optional, but is beneficial.

The housing 12 of the tool 10 is ergonomic and fits comfortably into a user's hand. The activation device is shown as being a button 20. The button 20 is centrally located on the housing 12 in order to allow the user the grip the housing 12 and easily press the button 20 to activate the spindle 18/motor 14. The housing 12 has a curved sidewall 30, a flat bottom surface 32, and a flat upper surface 34 through which the spindle 18 extends. A depression 36 is positioned on the sidewall 30 of the tool 10 for locating the button 20 therein.

As shown in the figures, the tool 10 is narrower at a top end 34 and bottom end 32 and wider in the middle. This helps the tool 10 to fit well in a user's hand. FIGS. 1 and 4-6 depict the tool 10 with a cover 38 installed over the platform 24 and spindle 18. The cover 38 can help to protect the spindle 18 end of the tool 10 when not in use. The cover 38 snap fits onto the housing 12 of the tool 10 using known techniques. The cover 38 is optional.

FIG. 3 depicts an interior view of the tool 10, with part of the housing 12 removed. The housing 12 may be a two-part housing 12 with a center seam line, or may be a different configuration. The interior of the housing 12 includes a battery compartment 40 for receiving a battery 16. The battery 16 is coupled to a motor 14 and the motor 14 has a shaft that is coupled to the spindle 18. A button 20 or activation switch is coupled to the motor 14 for activating the motor 14. When the motor 14 is activated, the spindle 18 spins. A platform 24 is shown coupled to the spindle 18. The platform 24 has a hollow interior with reinforcing ribs shown from the underside. The interior of the housing 12 has ribs 42 to support the various members housed in the housing 12. The housing 12 covers may snap together or connected together by a coupling, such as a screw or pin (not shown). Other ways for forming the housing 12 will be readily apparent to the skilled artisan.

Figure 6:
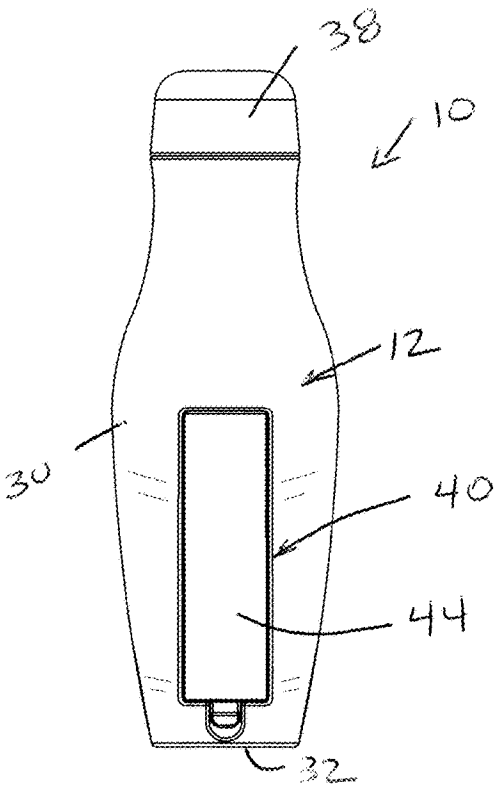
FIG. 6 is a rear view of the device of FIG. 4.
Figure 5:
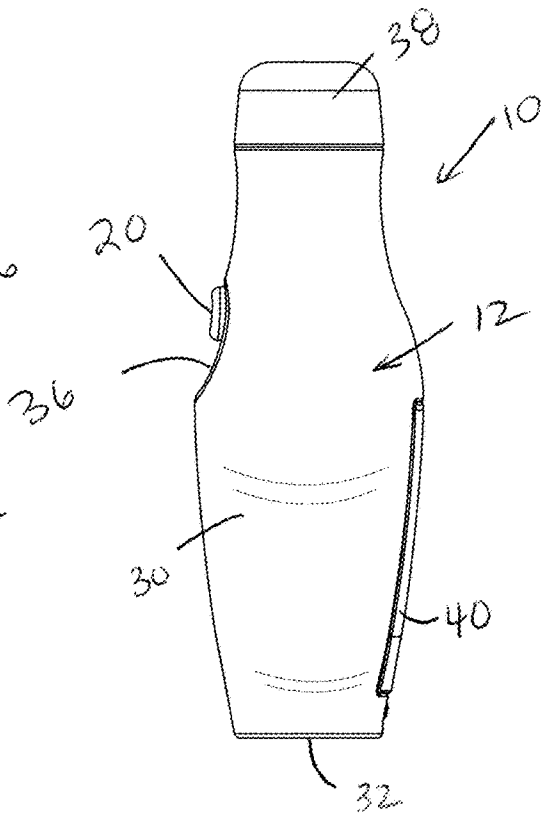
FIG. 5 is a side view of the device in FIG. 4.
Figure 4:
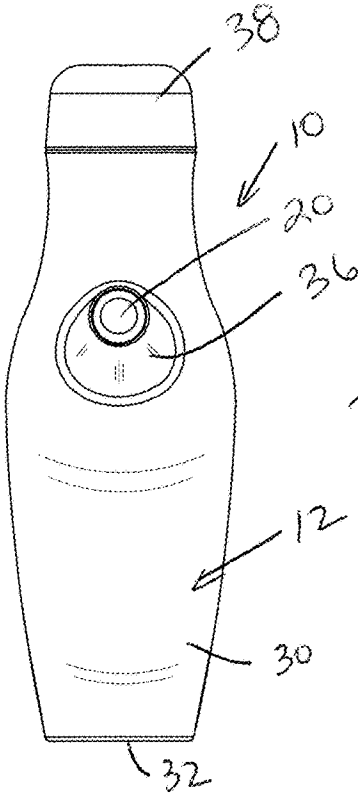
FIG. 4 depicts a front view like that in FIG. 3, but with a cap or cover positioned over the spindle.

A rear view of the tool 10 is shown in FIG. 6, which depicts a door 44 for holding a battery 16. The door 44 is shown to be rectangular and is meant for receiving a AAA battery 16. Other sizes of batteries 16 may also be utilized and a different shaped door 44 could be used, if desired.

While the example tool 10 is described as being battery powered, it could alternatively be powered with a power cord (not shown) that couples to a wall outlet (not shown). The example tool 10 could also be capable of being powered by both a power cord and a battery 16, so that the tool 10 may be made portable when desired by the user. The battery could be rechargeable so that the user plugs the tool 10 in when not in use and removes the power cord when in use. The power button 20 is shown positioned on the side of the tool 10. Any type of power button 20 may be used. In the example shown, the power button 20 is a push button and the user holds the button 20 down to spin the spindle 18. Alternatively, the button 20 could be a rocker type button that stays on when rocked in one direction and/or has a pulse function in one direction. Other types of on/off switches may be used, as known by those of skill in the art.

The platform 24 is shown as being disc-shaped with a height that is a percentage of the length of the spindle 18. The platform 24 is not required to have the height shown and could have other heights. The platform 24 could have other shapes and does not have to be round. It could be square, triangular, or other shapes, as desired. The spindle 18 does not have to be positioned directly in the center of the platform 24 or housing 12, although the examples shown herein show the spindle 18 positioned in the center of the platform 24 and the center of the housing 12. The platform 24 is removed by sliding it off the spindle 18. The platform 24 helps to prevent the wound spool of material from separating or fanning out when the end of the strip is removed from the slot 22 in the spindle 18. Alternatively, the spindle 18 could be designed to retract into the housing 12 and a platform 24 would not be required. Other techniques for permitting removal of the strip of material from the spindle 18 may be utilized, such as opening the slot 22 in the spindle 18 to permit the paper to easily slide off.

The tool 10 may include a cap 38 that seats at the spindle 18 end of the tool 10 in order to cover the spindle 18 and platform 24 during non-use, as shown best in FIGS. 1 and 4-6. The tool 10 may include a separate on/off button (not shown) in addition to the button 20 that is used to activate the spindle 18, if desired. The separate on/off button could be used to turn the tool 10 on or off, with the button 20 being used to pulse the motor 14. Different sized platforms 24 may be supplied with the tool 10, if desired. The tool 10 is shown as having a certain exterior shape. Other shapes may alternatively be used without departing from the invention, as known by those of skill in the art.

Figure 1:
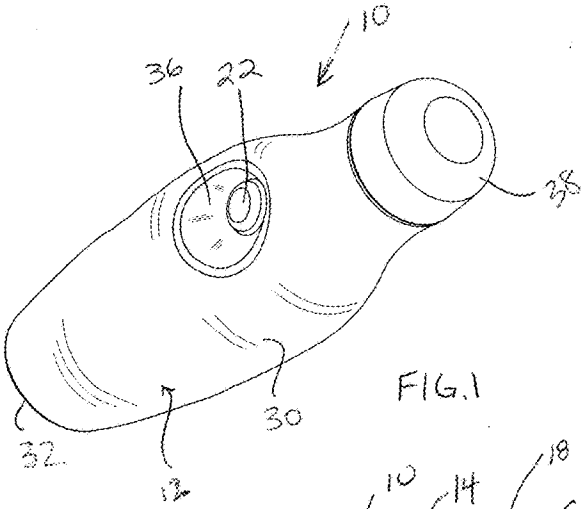
FIG. 1 depicts a perspective view of an example tool according to the invention.
Figure 7:
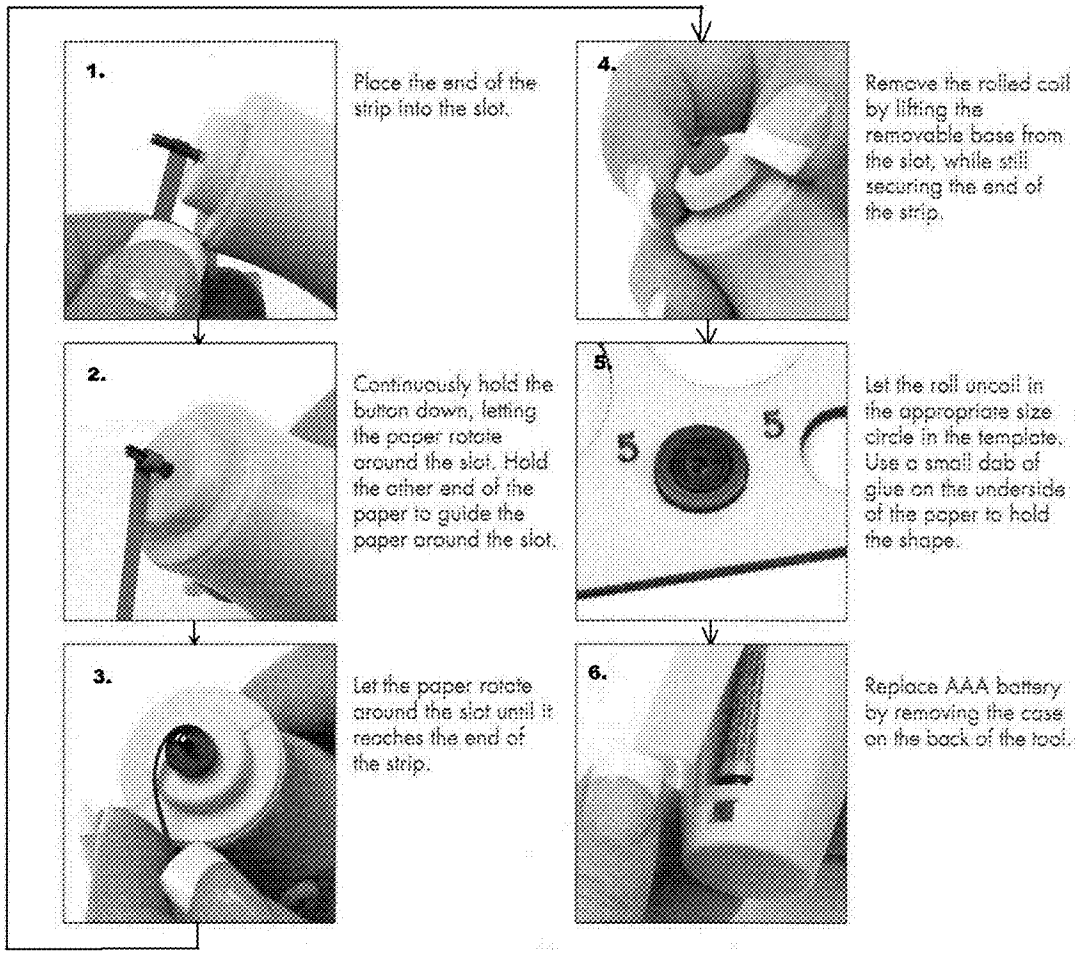
FIG. 7 depicts a flow chart showing the operation of the example tool.

FIG. 7 depicts a method for operating the tool 10 and for quilling. FIGS. 1 shows in box 1 that the user inserts an end of a strip of quilling material into the slot 22 of the spindle 18. The platform 24 is positioned around the spindle 18 prior to coupling the quilling material to the slot 22. In box 2, the user holds down the activation button 20 and lets the paper rotate on the spindle 18. The user holds the paper to guide it around the spindle 18. Box 3 shows that the strip of material should be wound around the spindle 18 until the end of the strip of material is reached. Box 4 shows how the platform 24 can be removed along with the coiled strip of material. In this box, the user holds the strip of wound material in place while removing the platform 24 from the tool 10. Box 5 shows a template that is used in quilling that has a series of sized holes. In Box 5, the user removes the wound material from the platform 24 and places it into the template so that the material can unwind to fit the size of the hole in the template. Box 6 shows how the battery 16 can be replaced.

A quilling tool 10 includes a housing 12, a motor 14, a spindle 18 and a removable member 24. The motor 14 is positioned inside the housing 12 and is coupled to a power source 16. The spindle 18 is coupled to the motor 14 and extends from the housing 12. The motor 14 is operable to rotate the spindle 18 when powered by the power source 16. The spindle 18 has a portion 22 for receiving a separate strip of material. The removable member 24 is positioned adjacent the spindle 18 and the housing 12. The removable member 24 is removable from the housing 12 in order to remove a wound strip of paper.

The removable member may be a platform 24 that is movable longitudinally on the spindle 18. The portion of the spindle 18 that receives a separate strip of paper may be a slot 22 22 defined through the spindle 18. The motor 14 may be battery powered and the housing 12 may include a recess 40 for receiving at least one battery 16 therein. The motor 14 may be powered by a wall outlet via a power cord. An activation member 20 may be coupled to the housing 12 and the motor 14 for turning the motor 14 on and off. When the activation member 20 is activated, the motor 14 is on, and when the activation member 20 is inactivated, the motor 14 is off.

The housing 12 may be elongated and has a top end 34 where the spindle 18 is positioned, a bottom end 32, and a side wall 30. The activation member 20 may be coupled to the side wall 30 of the housing 12. The bottom end of the housing 12 may be a flat wall 32 that permits the housing 12 to stand on an underlying surface. The side wall 30 may be rounded or other shapes, as desired. The activation member 20 may be positioned in a depression 36 that is located on the side wall 30. The tool 10 may also include a cover 38 for covering the spindle 18. The cover 38 is removable and replaceable on the housing 12.

In another embodiment, a quilling tool 10 includes a housing 12, a motor 14, a spindle 18, and a power switch 20. The housing 12 has an ergonomic shape for grasping in the hand. The motor 14 is positioned in the housing 12 and coupled to a power source 16. The spindle 18 is coupled to the motor 14 and has an end that extends from the housing 12. The spindle 18 is configured to rotate via the motor 14. The spindle 18 has an attachment feature 22 positioned at the end that extends from the housing 12 for removably receiving a strip of paper so that the paper is held in position when the spindle 18 rotates, but is removable from the spindle 18. The power switch 20 is for operating the motor 14 to rotate the spindle 18.

The power source may be a power cord coupled to a wall outlet, or at least one battery 16. The power source may be at least one battery 16 and the housing 12 may include a compartment 40 for housing the battery 16. The battery compartment 40 may have connections for electrically joining the battery 16 to the motor 14 and the power switch 20. The spindle 18 may include a slot 22 at the end of the spindle 18 that extends from the housing 12, with the slot 22 configured to trap an end of a strip of paper.

A platform 24 may be positioned around part of the length of the spindle 18 that extends from the housing 12. The platform 24 is removable from the spindle 18. The spindle 18 may have a length that is longer than the height of the platform 24 such that part of the spindle 18 is positioned outside the platform 24 when the platform 24 is installed on the housing 12. The attachment feature may be a slot 22 that is positioned at the outer end of the spindle 18 so that slot 22 is only positioned outside the height of the platform 24. The tool 10 may also include a cover 38 for snapping onto the spindle end of the housing 12.

In another embodiment, a method for quilling strips of material includes the steps of providing a motorized tool 10, coupling a strip of material to the tool 10, operating the tool 10, and removing a wound strip of material from the tool 10. The motorized tool 10 has a housing 12 and a rotatable spindle 18 extending from the housing 12. The spindle 18 has an attachment feature 22 for coupling a strip of material to the spindle 18. The coupling step includes coupling a strip of material to the attachment feature 22 of the spindle 18. The operating step involves operating the motorized tool 10 such that the spindle 18 rotates and winds the strip of material about the spindle 18.

The tool 10 may also include a platform 24 coupled to the spindle 18. The platform 24 may have a flat upper surface, with the attachment feature 22 being at an end of the spindle 18 such that the platform 24 is positioned between the attachment feature 22 and the housing 12 of the tool 10. The method may also include sliding the platform 24 off the spindle 18 after the material has been wound in order to remove the wound strip of material from the spindle 18. The tool 10 may also include a button 20 coupled to the housing 12 and the motor 14 for operating the motor 14. The step of operating the motorized tool 10 may also include pressing the button 20 to rotate the spindle 18 and releasing the button 20 to stop the rotation of the spindle 18.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A quilling tool comprising:

a housing;

a motor positioned inside the housing and coupled to a power source;

a spindle coupled to the motor and extending from the housing, said motor operable to rotate the spindle when powered by the power source, with the spindle having a portion for receiving a separate strip of paper; and a removable member positioned adjacent the spindle and the housing, wherein said removable member is removable from the body in order to remove a wound strip of paper.

2. The tool of claim 1, wherein the removable member is a platform that is movable longitudinally on the spindle.

3. The tool of claim 1, wherein the portion of the spindle that receives a separate strip of paper is a slot defined through the spindle.

4. The tool of claim 1, wherein the motor is battery powered and the housing includes a recess for receiving at least one battery therein, or the motor is powered by a wall outlet via a power cord.

5. The tool of claim 1, further comprising an activation member coupled to the housing and the motor for turning the motor on and off, wherein when the activation member is activated, the motor is on and when the activation member is inactivated, the motor is off.

6. The tool of claim 1, wherein the housing is elongated and has a top end where the spindle is positioned, a bottom end, and a side wall, and the activation member is coupled to the side wall of the housing.

7. The tool of claim 6, wherein the bottom end comprises a flat wall that permits the housing to stand on an underlying surface, the side wall is rounded, and the activation member is positioned in a depression that is located on the side wall.

8. The tool of claim 1, further comprising a cover for covering the spindle, said cover being removable and replaceable on the body.

9. A quilling tool comprising:

a housing having an ergonomic shape for grasping in the hand;

a motor positioned in the housing and coupled to a power source;

a spindle coupled to the motor and having an end that extends from the housing, said spindle configured to rotate via the motor, with the spindle having an attachment feature positioned at the end that extends from the housing for removably receiving a strip of paper so that the paper is held in position when the spindle rotates, but is removable from the spindle; and a power switch for operating the motor to rotate the spindle.

10. The tool of claim 9, wherein the power source is a power cord coupled to a wall outlet, or at least one battery.

11. The tool of claim 10, wherein the power source is at least one battery and the housing includes a compartment for housing the battery, with the battery compartment having connections for electrically joining the battery to the motor and the power switch.

12. The tool of claim 9, wherein the spindle includes a slot at the end of the spindle that extends from the housing, with the slot configured to trap an end of a strip of paper.

13. The tool of claim 9, further comprising a platform positioned around part of the length of the spindle that extends from the housing, said platform being removable from the spindle.

14. The tool of claim 13, wherein the spindle has a length that is longer than the height of the platform such that part of the spindle is positioned outside the platform when the platform is installed on the housing, and the attachment feature is a slot that is positioned at the outer end of the spindle so that slot is only positioned outside the height of the platform.

15. The tool of claim 9, further comprising a cover for snapping onto the spindle end of the housing.

16. A method for quilling strips of material comprising:

providing a motorized tool having a body and a rotatable spindle extending from the body, said spindle having an attachment feature for coupling a strip of material to the spindle;

coupling a strip of material to the attachment feature of the spindle;

operating the motorized tool such that the spindle rotates and winds the strip of material about the spindle; and removing the wound strip of material from the spindle.

17. The method of claim 16, wherein the tool further comprises a platform coupled to the spindle, said platform having a flat upper surface, with the attachment feature being at an end of the spindle such that the platform is positioned between the attachment feature and the body of the tool; and further comprising the step of:

sliding the platform off the spindle after the material has been wound in order to remove the wound strip of material from the spindle.

18. The method of claim 16, wherein the tool further comprises a button coupled to the body and the motor for operating the motor; and wherein the step of operating the motorized tool includes pressing the button to rotate the spindle and releasing the button to stop the rotation of the spindle.

* * * * *